US005497511A

United States Patent [19]

Zade

[11] Patent Number: 5,497,511

[45] Date of Patent: Mar. 12, 1996

[54] PROTECTIVE PANTS FOR THE HIP

[76] Inventor: Isimail Y. Zade, 25 Larissa La., Thornwood, N.Y. 10594

[21] Appl. No.: 207,584

[22] Filed: Mar. 8, 1994

[51] Int. Cl.[6] ..... A41D 13/00; A41D 27/26; A41B 9/04

[52] U.S. Cl. ..... 2/22; 2/238; 2/267; 2/408

[58] Field of Search ..... 2/2, 16, 22, 23, 2/24, 227, 238, 267, 78.2, 408

[56] References Cited

U.S. PATENT DOCUMENTS

| | | | |
|---|---|---|---|
| 3,909,847 | 10/1975 | Holt et al. | 2/2 |
| 3,945,042 | 3/1976 | Lobo | 2/2 |
| 4,151,613 | 5/1979 | Rhee | 2/2 |
| 4,462,115 | 7/1984 | Carlson et al. | 2/2 |
| 4,481,679 | 11/1984 | Hayes | 2/2 |
| 4,870,706 | 10/1989 | Ketcham et al. | 2/2 |
| 5,103,505 | 4/1992 | Llorens | 2/267 X |
| 5,105,473 | 4/1992 | Valtakari | 2/267 X |
| 5,337,418 | 8/1994 | Kato et al. | 2/2 |

*Primary Examiner*—Paul C. Lewis
*Attorney, Agent, or Firm*—Martin J. Spellman, Jr.

[57] ABSTRACT

A pants for aiding and preventing injury to the hip and upper femur. The pants are made from resilient material having body cushioning properties and four pockets. The pockets are positioned with a pocket on each side of the back and one adjacent hips on each side. Pockets are positioned to cover the hips and upper femur area of the wearer. A pair of rigid pads are placed within the pockets on each side of the back and a second pair of rigid pads are provided for placement within the pockets on each side adjacent to the hip. The pockets located on the back are fitted with reenforcements such as plastic spaced apart and running horizontally therein to allow for flexibility of movement about a horizontal axis. Pads on the side of the hip are fitted with reenforcement means spaced apart and running vertically to allow for flexibility and movement about a vertical axis.

5 Claims, 3 Drawing Sheets

PROTECTIVE PANTS FOR THE HIP

FIELD OF THE INVENTION

The present invention teaches special pants designed to assist individuals who fall and get hip fractures. More particularly, the present invention is designed to protect the wearers' femur and hip bone.

BACKGROUND OF THE INVENTION

The human body is basically unstable, with a very small support base relative to its height. Control of balance is a circular process which is dependent upon several factors: sensory input, central nerve processing, and muscular activity. If any of these factors do not function well, the person will fall. Once an individual falls, particularly the elderly, this often results in the breaking of the hip bone.

Several attempts have been made to develop a body protector devices designed to protect various parts of the human body such as: the elbows, the knees, and the chest.

U.S. Pat. No. 3,990,440 discloses inexpensive air permeable body protectors adapted to be positioned on the elbow or heel of bedridden patients for protection against the development of ulcers and the like.

U.S. Pat. No. 4,120,052 discloses a cushioned protector aid preventing injury to the knee and/or elbows of the wearer, and includes a stretchable sleeve of textile material which is easily drawn over and resiliently engages and covers the elbow or knee of the wearer.

U.S. Pat. No. 4,272,850 discloses a protective pad for use in cushioning the body consisting of resilient organic foam polymeric material with body cushioning properties.

Finally, U.S. Pat. No. 5,065,457 teaches a body protector for sportsman which allows perspiration from the sportmens' skin to evaporate while the body protector is being worn.

There are presently existing for athletes and workers, numerous protection devices for the upper and lower extremities, the back, thorax, shoulders, neck, face, and head. There are, however, no devices to protect the femur and hip.

The present invention protects the hip from fracture[,] at any age, especially the elderly who are predisposed to falling, and whose bones are fragile and brittle. Hip fracture is a disease of public health, with consequences as severe as morbidity, disability, or even death. More than 290,000 hip fractures occur in this country each year. Approximately every fourth bed in the orthopaedic ward is occupied by a patient with a hip fracture, accounting for billions of dollars spent each year.

Falling occurs mostly in older persons, especially those who are having physical or mental problems such as hypertension, diabetes, stroke, dizziness, Parkinson's disease, Alzheimer's, dementia, and many other physical and mental illnesses. Also, statistics show that the mortality rate following surgery after hip fracture is 40% greater than non-hip fracture surgery. Another study shows that 81% of all falls occur on the side, the right or left side, and generally cause fracturing or breaking of the neck of the femur as compared to the other parts of the pelvic bone.

It is therefore an object of the present invention to provide a device which protects the hip.

Another object of the present invention is to provide a device which protects the hip from fractures at an old age.

A further object of the present invention is to provide a device which protects the hip and femur during a fall.

These and other objects will become apparent as we proceed through the detailed description.

SUMMARY OF THE INVENTION

The present invention is concerned with a protective device for aiding and preventing injury to the hip and upper femur. It comprises a pants made from resilient material, having body cushioning properties and four pockets. The pockets are positioned with one pocket on each side of the bottom and one pocket on each side adjacent to the hip. All four pockets are positioned in a manner to cover the hip and upper femur area of the wearer. Plastic pads designed with different sizes of rigid plastic sticks with different width and length, are provided and between the sticks is a 1/16" inch to 1/8" inch distance which is filled with flexible plastic material that adheres the sticks together and gives flexibility for movement. They have concave and convex smooth sides. Two of them adapt to each side of the bottom, and the other two at each side of the pelvic side which are rigid pads. All rigid pads have about 1/16 to 1/8 inch of foam which sticks to the inner side of the rigid pads for more protection and comfort. A rigid pad is placed within the pockets. The pads that are adapted to cover and protect the hip and the upper femur area of the wearer are placed within the pockets located on each side of the back, being fitted with rigid enforcement means spaced apart and running vertically within said pads and allowing for flexibility of movement vertically.

The wearer can sit, get up, and lay down with this protective pants without restrictions of movement. All three kinds of pants will have all sizes, the size of the pockets and pads will be of suitable size for the size of the pants.

ILLUSTRATIVE SPECIFIC EMBODIMENT

Figure 1:
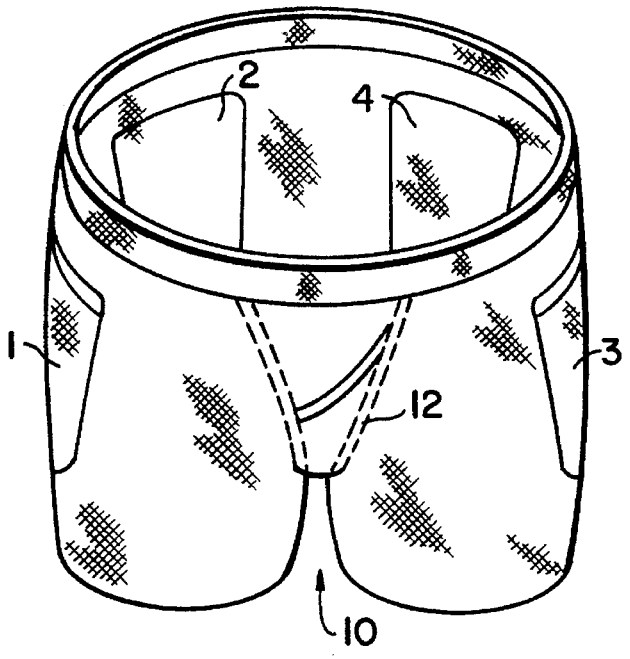
FIG. 1 is a perspective view of the protective device of the present invention, showing pants and four pockets for a male.

The protective device of the present invention comprises a pants made from resilient material having body cushioning properties and four pockets, as more fully illustrated in FIG. 1 which shows pants 10 having four pockets, all four pockets positioned with one pocket on each side. A right side pocket 1 and a left side pocket 3. At the rear of the pants 10 are located a right rear pocket 2 and a left rear pocket 4. Also located on the pants 10 is front opening 12, which allows for access by a male in the performing of normal body activities.

Figure 2:
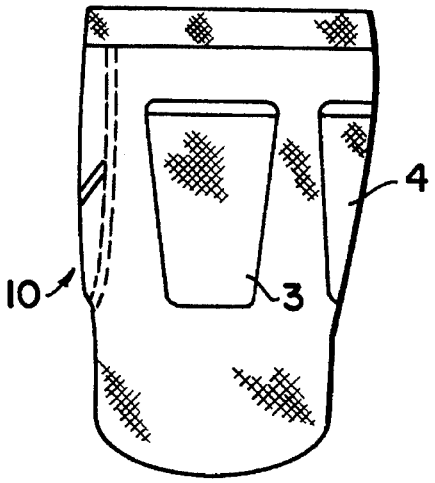
FIG. 2 is a side view of the protective device showing the side pocket adjacent to the hip and a portion of the back pocket.

FIG. 2 shows a side view of the protective device, detailing the side pocket 3 covering the hip and upper femur area of the wearer and back pocket 4 covering the rear or bottom area of the wearer. Also shown is the front opening 12.

Figure 3:
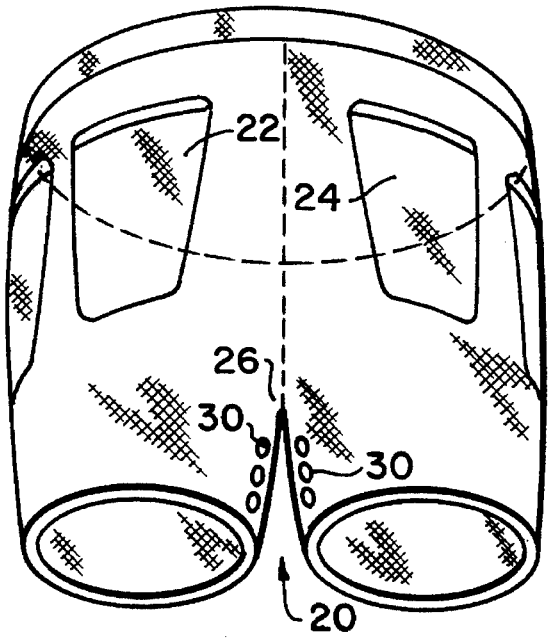
FIG. 3 is a rear view of the protective device showing the pockets located on each side of the back for a female.

FIG. 3 shows the rear of the protective device and more particularly pants 20 with back pockets 22 and 24 respectively. Also shown in FIG. 3 is a perineum opening 26 adapted for use by a female. This opening comprises reclosable snaps 30 running along both sides of the inner portion of the pants within the perineum area 26 and allows for complete opening of the pants. These snaps can be opened and closed by the user if needed for defecation and urination. Pants 20 can be worn by both males and females.

Figure 4:
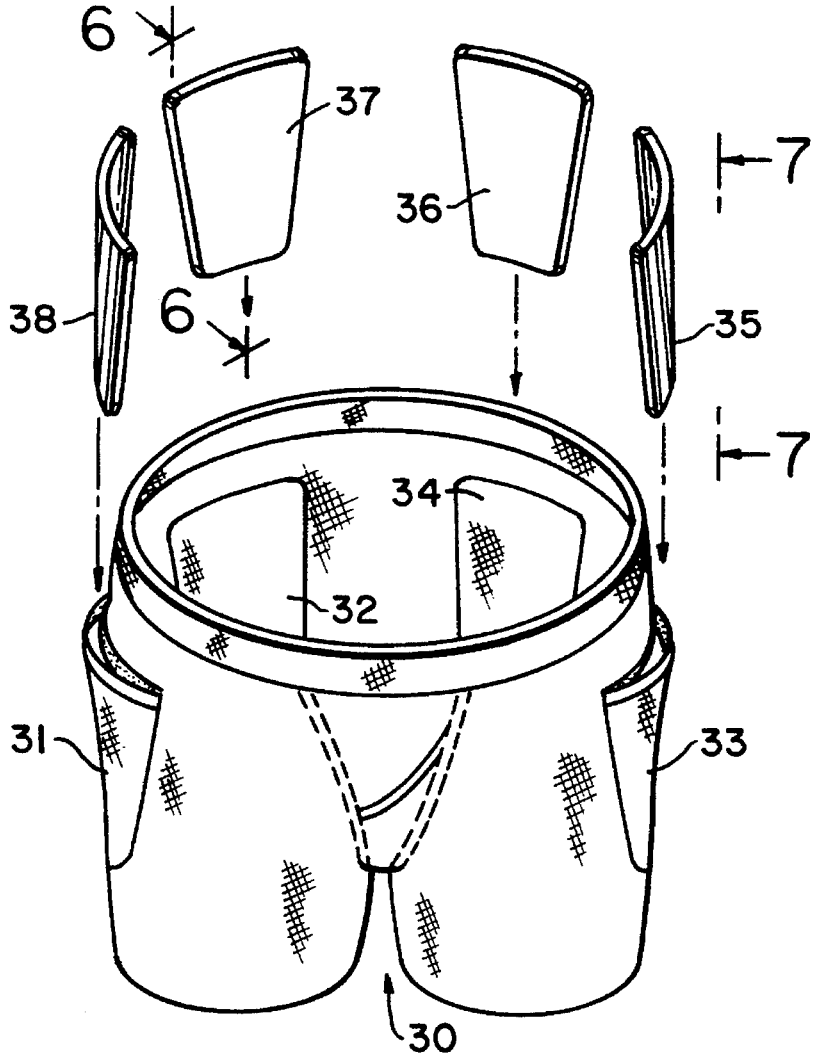
FIG. 4 is a front view of the protective device of the present invention showing the pockets being fitted with pads.

FIG. 4 shows pants 30 with side pockets 31 and 33 and rear pockets 32 and 34 respectively. Also shown in FIG. 4 are rigid pads being placed within the pocket. Within pocket 31 is placed pad 38 which pad is designed to fit within the pocket and conform vertically to the curvature of the body during use, and without interfering wit the wearer's comfort.

Within pocket 32 is placed pad 37 which pad is also designed to fit within said pocket and conform laterally to the curvature of the rear of the body during use and without interfering with the wearer's comfort. This also applies to pad 35 which similar to pad 38 and is placed within side pocket 33 and rear pad 36 which is similar to paid 37 and is placed within pocket 34. FIG. 4 also shows a front opening 12 designed for male use.

Figure 5:
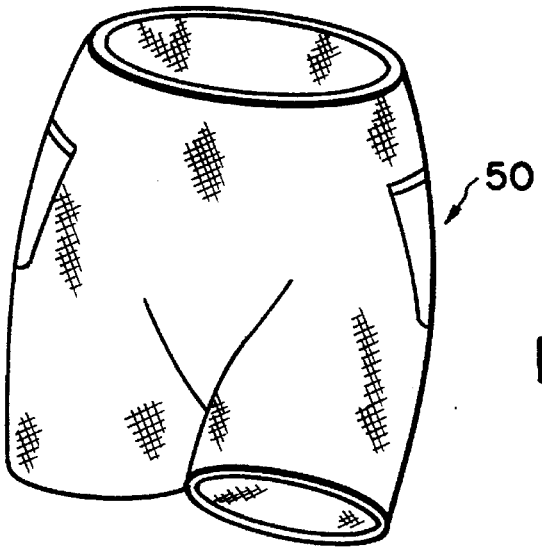
FIG. 5 is a perspective view of the protective device with no perineum opening.

FIG. 5 shows pants 50 without a perineum opening. Pants 50 is the same as the other pants of the present invention with the exception of the opening. The lack of an opening does not affect the functionality of the device of the present invention with respect to its protective qualities.

Figure 6:
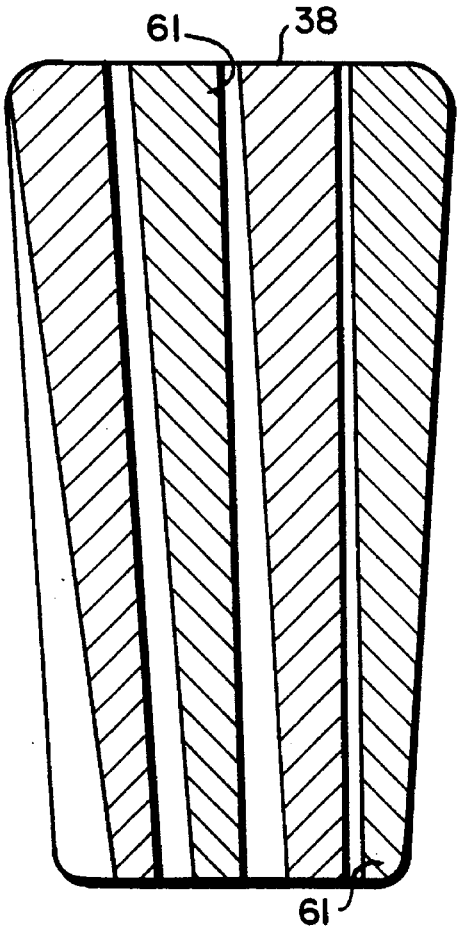
FIG. 6 is a one dimensional view of the side pads showing the rigid enforcement means running vertically.

FIG. 6 shows rigid reenforcement means 61 running vertically within pad 38. Each pad typically contains up to about 5–6 reenforcement means depending upon the width of the pad. These reenforcement means generally vary in width from about ¾ inch to ½ of an inch from the top to bottom, and the length depends upon the length of the pants.

Figure 7:
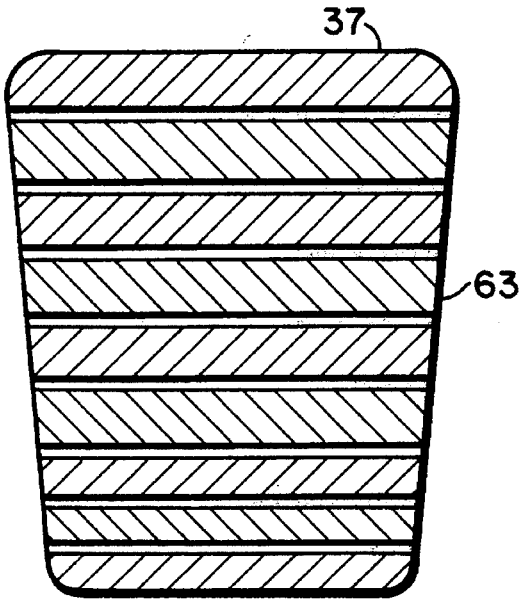
FIG. 7 is a one dimensional view of the back pads showing rigid enforcement means running laterally.

FIG. 7 shows rigid reenforcement means 63 running laterally within pad 37. Each pad typically contains up to about 16 reenforcement means depending upon the length of the pad. These reenforcement means generally vary in width from about ¾ inch to ¼ inches from top to bottom and tapers in length as they approach the bottom. The reenforcement means are typically made from hard light weight plastic. Other similar material or natural fibers or aluminum may be utilized, provided that they have the necessary flexibility and strength.

The plastic pads of the present invention are two pairs of pads designed with different shapes. One pair adapts to the bottom, and covers mostly the ischial tuberositio area, and the other two cover the side of the pelvis, greater trochanter, neck and head of the femur. The inner and outer members of the pockets are connected together around the peripheral edges within which the enforcement means can be replaced if need be.

The plastic pads can be taken out of the pockets, and can be placed back into the pockets again when the protective features are desired. These plastic pads are designed in a manner which allows the wearer to perform normal body functions. Generally the plastic pad compound configuration is of greater length than width to cover lengthwise the upper parts of the femur, greater trochanter, neck, and head of the femur and pelvis bone. When these pads are used, they protect these areas of the body in case of a fall. The pads of the present invention can be worn with other clothes such as pajamas, or trousers or the like.

All three kinds of protective pants will have different sizes: for example: They will start at a 22 inch waist and go up to a 50 inch waist with showing measurements of proximal circum (ischial level) and distal circum (proximal to femoral.) The size of the pockets and pads will be suitable size for the size of the pants. The material of the pants will be light and washable, soft thin and durable with some elasticity to make it easier to wear, and also to adapt to the pelvic area.

This invention has been described with reference to a preferred embodiment, it is to be clearly understood by those skilled in the art that the invention is not limited hereto. Other similar protective means for the hip and upper femur may be contemplated as being within the spirit and scope of the present invention. Accordingly, it is not intended that the invention be limited except by the appended claims.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed:

1. A protective device for aiding and preventing injury to the hip and upper femur comprising: pants made from resilient material having body cushioning properties and four pockets, said pockets being positioned with one pocket on each side of the back and one pocket on each side adjacent to the hip, all four pockets positioned in a manner to cover the hip and upper femur area of the wearer; two pairs of rigid pads; a first pair for placement within the pockets located on each side of the back and the second pair for placement within the pockets located on each side adjacent to the hip; the first pair of pads being fitted with reinforcement means spaced apart and running horizontally therein and allowing for flexibility of movement about a horizontal axis; a second pair of pads being fitted with reinforcement means spaced apart and running vertically and allowing for flexibility of movement about a vertical axis, said rigid reinforcement means for said first pair of pads varying in thickness from ¾ inches to ¼ inch from a top portion to a bottom portion of the pad and tapering in length from the top to the bottom of the pad.

2. A device as claimed in claim 1 wherein said pads have 1/16 of an inch to ⅛ of an inch of foam which is attached to the inner side of the pads for more protection and comfort.

3. A device according to claim 1 wherein the rigid enforcement means within the pads and running vertically varies in width from ¾" of an inch to ½" of an inch from the top to the bottom while the length remains consistent.

4. A device according to claim 1 or wherein said reinforcement means comprises hard plastic.

5. A device according to claim 3 further comprising an opening within the perineum area to provide access by the wearer.

* * * * *